US005173161A

United States Patent [19]

Gramm

[11] Patent Number: 5,173,161

[45] Date of Patent: Dec. 22, 1992

[54] DEVICE FOR APPLYING AND/OR REMOVING COATINGS ON WORKPIECES

[76] Inventor: Gerhard Gramm, Waldstrasse 15, D-7533 Tiefenbronn-Mulhausen, Fed. Rep. of Germany

[21] Appl. No.: 700,130

[22] PCT Filed: Sep. 22, 1989

[86] PCT No.: PCT/DE89/00600

§ 371 Date: May 24, 1991

§ 102(e) Date: May 24, 1991

[87] PCT Pub. No.: WO90/05801

PCT Pub. Date: May 31, 1990

[30] Foreign Application Priority Data

Nov. 24, 1988 [DE] Fed. Rep. of Germany ..... 3839755
Feb. 8, 1989 [DE] Fed. Rep. of Germany ..... 3903696

[51] Int. Cl.[5] ..... C25D 17/00; C25D 21/10; C25D 21/22

[52] U.S. Cl. ..... 204/232; 204/237; 204/273; 204/284; 204/292; 204/297 R; 204/DIG. 13

[58] Field of Search ..... 204/198, 232, 237, DIG. 13, 204/284, 273, 297 R, 292

[56] References Cited

U.S. PATENT DOCUMENTS 3,616,437 10/1971 Yagishita ..... 204/232
3,658,470 4/1972 Zievers et al. ..... 204/232 X
4,139,446 2/1979 Suslin et al. ..... 204/278 X
4,337,134 6/1982 Norman ..... 204/278 X
4,592,819 6/1986 Suzuki et al. ..... 204/278 X

FOREIGN PATENT DOCUMENTS 0190539 12/1985 European Pat. Off. .
1034447 7/1958 Fed. Rep. of Germany .
1816141 6/1970 Fed. Rep. of Germany .
2619987 11/1976 Fed. Rep. of Germany .
2660711 3/1977 Fed. Rep. of Germany .
893570 4/1962 United Kingdom .
2001345 1/1979 United Kingdom .

OTHER PUBLICATIONS

Patent Abstracts of Japan, vol. 9, Number 119, May 23, 1985.

Patent Abstracts of Japan, vol. 7, Number 46, Feb. 23, 1983.

*Primary Examiner*—Donald R. Valentine
*Attorney, Agent, or Firm*—Speckman & Pauley

[57] ABSTRACT

A device and method for using the device for applyng and/or removing coating on workpieces are disclosed. The device comprises a medium conveying device and a container adapted to receive the workpieces. The container has an inlet line connected to a medium source, an outlet line connecting the container to a medium source, the medium source being positioned below the conveying device, and a control device which connects the inlet and outlet lines to the medium source. The conveying device is a vacuum pump incorporated in the outlet line of the container.

36 Claims, 5 Drawing Sheets

DEVICE FOR APPLYING AND/OR REMOVING COATINGS ON WORKPIECES

BACKGROUND OF THE INVENTION

1. Field of the Invention

This invention relates to a device for applying and/or removing coatings on workpieces, said device having conveying means and a container (process chamber) for receiving the workpieces, an inlet line which is connectable to at least one medium source and an outlet line connecting the container to the medium source, said medium source disposed below the conveying means where the connection between the lines and the medium source is established by at least one control device which is connectable to at least three different medium sources and disposed below the container.

In conventional devices of the type mentioned above and as described, for example, in German Patent DE 10 34 447 B or British Patent GB 893 570 A, the medium is pushed into the process chamber. As a result, when media are changed, deposits remain in the conveying device and mix with the new medium. Thus, it is not possible to use these devices where a high degree of purity of the medium transported into the process chamber is required. A further disadvantage is that, if the lines are damaged, the media are conveyed to the outside under high pressure, due to overpressure in the lines and the process chamber.

Based on the above state of the art, it is an object of this invention to provide a device which operates without forming deposits and which can be used with incompatible liquids.

This object is attained in accordance with one embodiment of this invention wherein wherein the conveying means is a vacuum pump and is incorporated into the outlet line of the container (process chamber).

Accordingly, because the circulation of the liquid from the medium source to the container (process chamber) and back to the medium source is achieved by under negative pressure, at most an implosion may occur in the lines or reservoirs in the event of leaks. As a result, the medium does not reach the outside, but rather flows back into the associated medium reservoir by itself. In addition, during operation there are no noticeable disruptions of the operation, because switching occurs very rapidly. In this way, one continuous cycle is replaced by another continuous cycle in extremely short time.

In accordance with one embodiment of this invention, the conveying means is positioned above the medium sources. As a result all lines between the container (process chamber) and the medium, as well as the control means, for example radial or axial sliding valves, are completely emptied if they are not under pressure and they are connected to the respective medium reservoirs so that medium can flow through them.

In accordance with another embodiment of this invention, at least one opening for a holder supporting at least one workpiece is provided in the wall of the container (process chamber). The holder has an elastically deformable sealing section which is connected under pressure with the wall. In accordance with yet another embodiment of this invention, the opening is provided with a sheathing in the form of a truncated cone which tapers towards the interior.

This invention is applicable to and can be utilized, in particular, in the field of medicine, and more particularly, in the dental field. In embodiments of this invention suitable for such applications, the container (process chamber) comprises a material which is resistant to the media. Because the container (process chamber), is under negative pressure the plugs in the container do not require threads, it being sufficient to place them in the openings after they have been supplied with the workpieces. Because of the negative pressure, a force directed towards the interior of the container acts on the plugs and prevents their separation from the container.

Located between the conveying device and the container (process chamber) is a magnetic valve (V) which, when opened, equalizes the pressure so that the liquid can flow from the container (process chamber) and the lines into the appropriate medium reservoir without leaving a residue. Opening of the valve to the outside is regularly performed shortly before the end of one process step in which a particular liquid is used. When the valve has been closed again, a new and different medium flows into the container (process chamber). The plugs can be removed from the openings at the end of the entire process. In accordance with another embodiment of this invention, an entire wall in the container comprises a plate equipped with the plugs and workpieces and removable from the container (process chamber), which is then connected with the container (process chamber).

In a device for making electrolytically producible coatings on metallic bodies, the surfaces of the portions of the workpieces extending into the container (process chamber) are designed as a cathode or an anode, where an anode or a cathode is disposed opposite the workpieces and an electrolyte flows between the electrodes. To ensure that the inflowing liquid sufficiently bathes the workpieces, a device which affects the direction of flow of the liquid is disposed within the container (process chamber). In accordance with one embodiment of this invention the inlet line is connected to the bottom and the outlet line is connected to the top of the container (process chamber), the device comprises two plates, disposed at a distance from the bottom and the top of the container (process chamber), which cover the bottom or the top except for a gap or a slit in the area of the wall supporting the workpieces. This ensures that the incoming liquid flows along the inside of the wall supporting the work pieces and optimally bathes the workpieces.

In accordance with another embodiment of this invention, the a device is connected to an electrolyte reservoir as well as to pre-rinse and rinse water reservoirs it is advantageous, if an ion exchanger for the regeneration of the rinse water is disposed in the pre-rinse and rinse water reservoir. It is additionally preferred that two ion exchangers each be disposed in each reservoir. Such an ion exchanger comprises a hollow body, removably connected to the inlet or outlet opening of the reservoir and having an inlet and outlet opening, where means for absorbing ions are disposed between these openings. The advantage of this configuration is that the ion exchangers—once they are no longer fulfilling their function —can be removed from the reservoir and replaced by fresh ones. In this case the user of the device does not come into contact with any liquid.

This invention also relates to a method for applying and/or removing coatings from workpieces with a device as previously described. In accordance with the process of this invention the workpieces are disposed in the interior of the container (process chamber), the workpieces are pre-treated, if required. The control device is actuated so that an electrolyte or another chemical liquid flows through the container (process chamber). After a defined coating has formed, the control device connects the lines to a rinsing liquid which then flows through the container (process chamber).

Some exemplary embodiments of the invention are schematically shown in the drawings and will be described in detail below.

DESCRIPTION OF PREFERRED EMBODIMENTS

Figure 1:
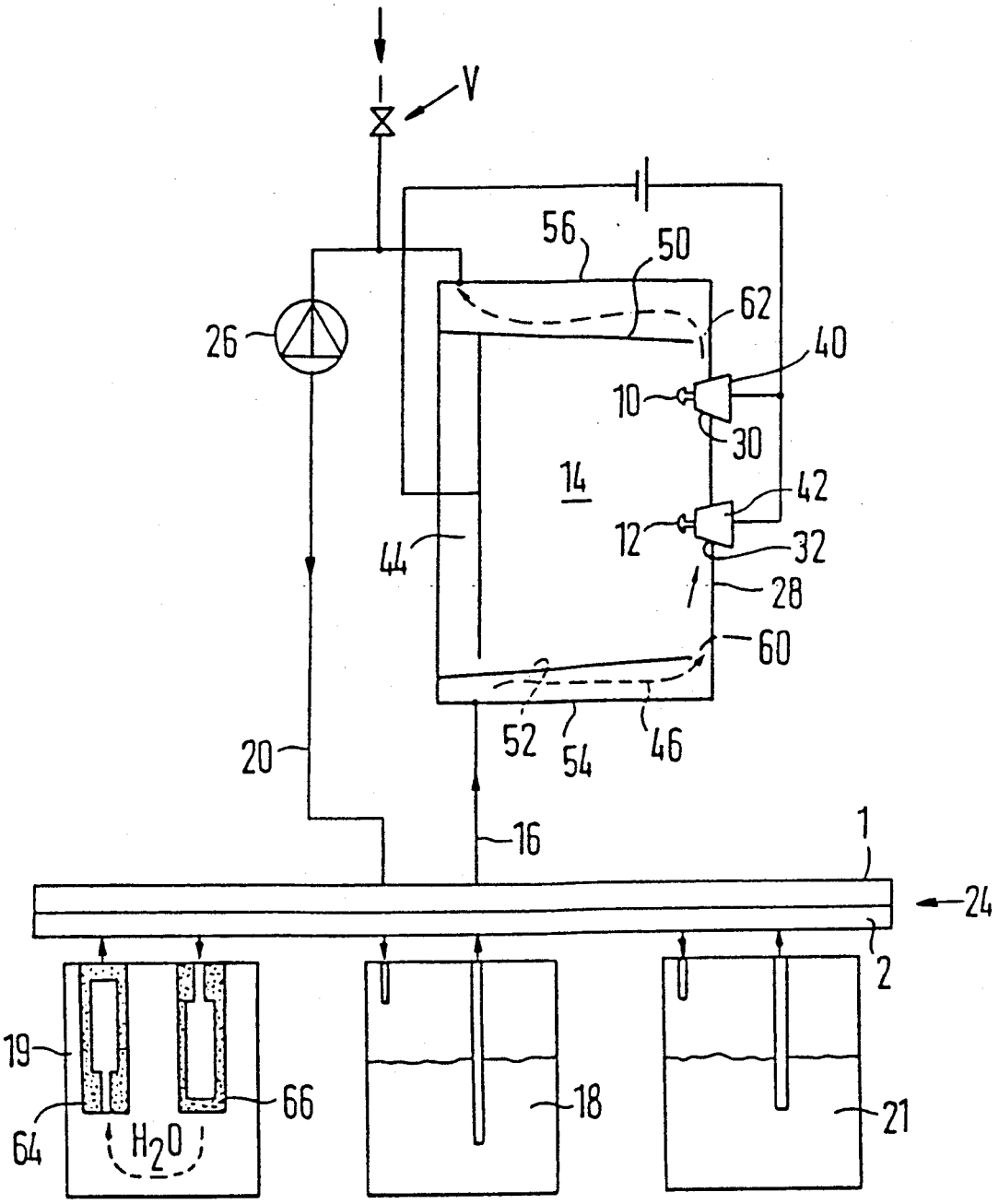
FIG. 1 is a schematic diagram of a device for galvanizing in accordance with one embodiment of this invention.

In FIG. 1, a device for applying and/or removing coatings from workpieces 10 and 12 in accordance with one embodiment of this invention is shown, having a container (process chamber) 14 which receives workpieces 10 and 12. An inlet line 16 is connected to at least one medium source 18 and an outlet line 20 connects the container (process chamber) 14 to the medium sources 18, 19 and 21. Inlet line 16, outlet line 20 and the medium sources 18, 19 and 21 are connected by a control device 24, in accordance with a preferred embodiment of this invention, a radial sliding valve.

The control device 24 is a valve comprising two circular disks 1 and 2, rotatable around a common axis in respect to each other. Control device 24 is disposed below the container (process chamber) 14 and above the medium sources 18, 19 and 21. Inlet line 16 and outlet line 20 extend essentially vertically so that no deposits are formed in them. The inlet line 16 and outlet line 20 can be connected to more than two reservoirs 18, 19 and 21 by radial sliding valve 24. A negative pressure conveying device 26 is incorporated into the outlet line 20. In accordance with one embodiment of this invention, conveying device 26 is a vacuum pump. Thus, the liquid is transported, for example, from the reservoir 18 into the line 16 and from there into the container (process chamber) 14. Because there is negative pressure in the container (process chamber) 14, the liquid flows through line 20 into the radial sliding valve 24 and from there back into the reservoir 18.

FIG. 1 further shows two openings 30 and 32 for the holders 40 and 42 supporting the workpieces 10 and 12 cut in the wall 28 of the container (process chamber) 14. The holders 40 and 42 have an elastically deformable sealing section secured under pressure to the wall 28. The sheathing of the openings 30 and 32 is a truncated cone which tapers towards the interior of container. To use the device shown in FIG. 1 for making electrolytically producible coatings on metallic bodies, the surface of the section of the workpieces 10 and 12 extending into the interior of the container (process chamber) 14 compromises a cathode or anode, while opposite of the workpieces 10 and 12, an anode 44 or cathode is disposed. The liquid flows between these two electrodes.

To assure that the liquid supplied through line 16 covers the workpieces 10 and 12, a device 50, 52, which affects the direction of flow of the liquid 46, is disposed inside the container (process chamber) 14. The inlet line 16 is connected in the bottom area of container, which preferably is funnel-shaped, and the outlet line 20 is connected in the top area of the container (process chamber) 14. The device 50, 52 affecting the flow of the liquid comprises two plates, disposed at a distance from the bottom 54 or the top 56 of the container (process chamber) 14, which cover the bottom 54 or the top 56 with the exception of gaps 60, 62, each said gap 60, 62 disposed in the wall area of the wall 28 supporting the workpieces 10 and 12.

FIG. 1 also shows a valve (V) incorporated in the line 20 as well as between the conveying device 26 and the container (process chamber). The valve (V), provided for ventilation is a magnetic valve arc is always operated when emptying the container (process chamber) 14 and returning the liquid present therein to the appropriate reservoir 18, 19 and 21. In this manner, pressure equalization occurs in the container (process chamber) 14, so that the liquid can flow downwards through the inlet line 16. It is not necessary to shut off the conveying device 26.

Figure 2:
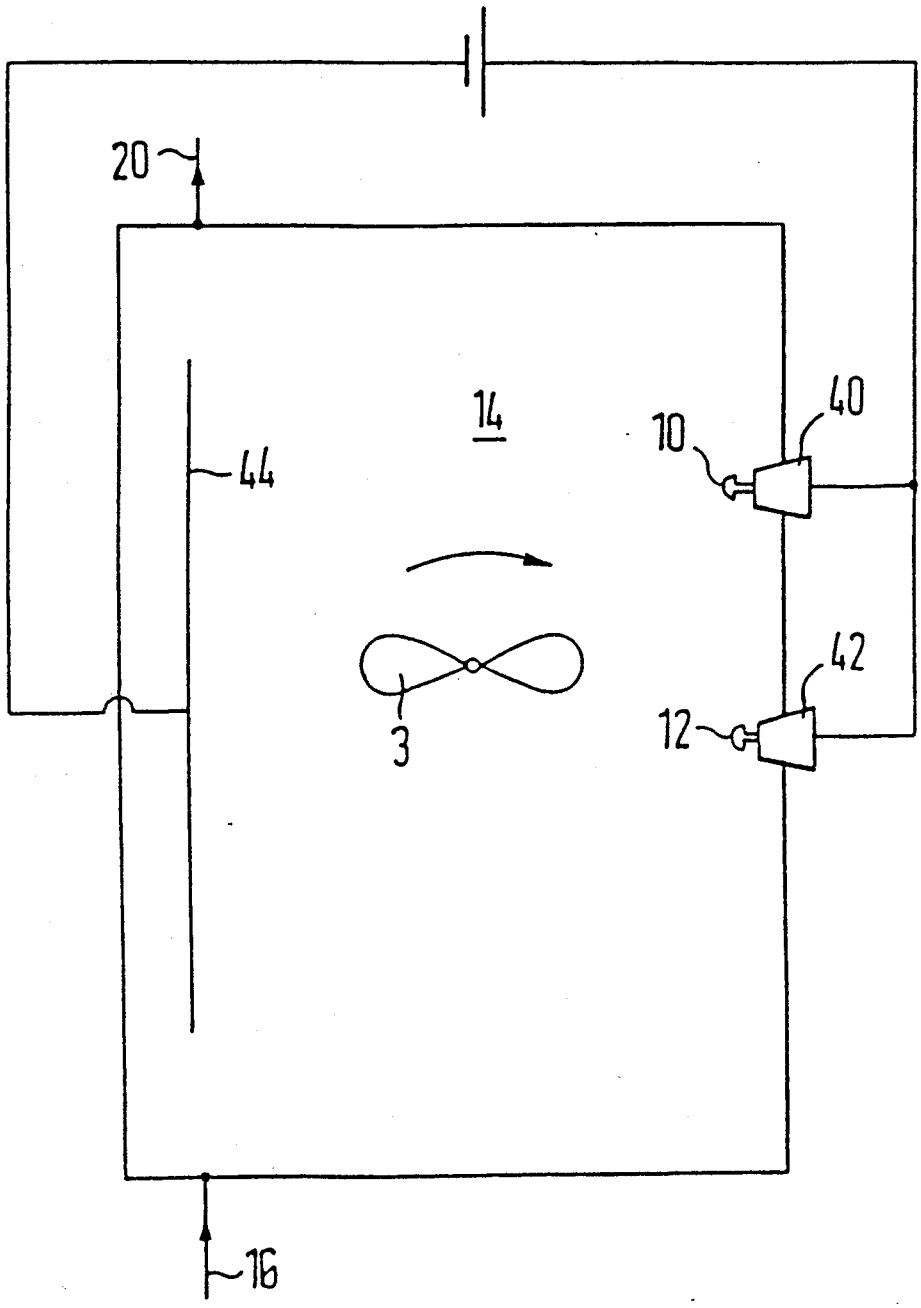
FIG. 2 is a schematic diagram of a container (process chamber), in accordance with one embodiment of this invention.

FIG. 2 shows, in accordance with another embodiment of this invention, a swirling device, propeller 3, disposed inside the container (process chamber) 14 to enhance the bathing of workpieces 10, 12 in the inflowing electrolyte.

Figure 3:
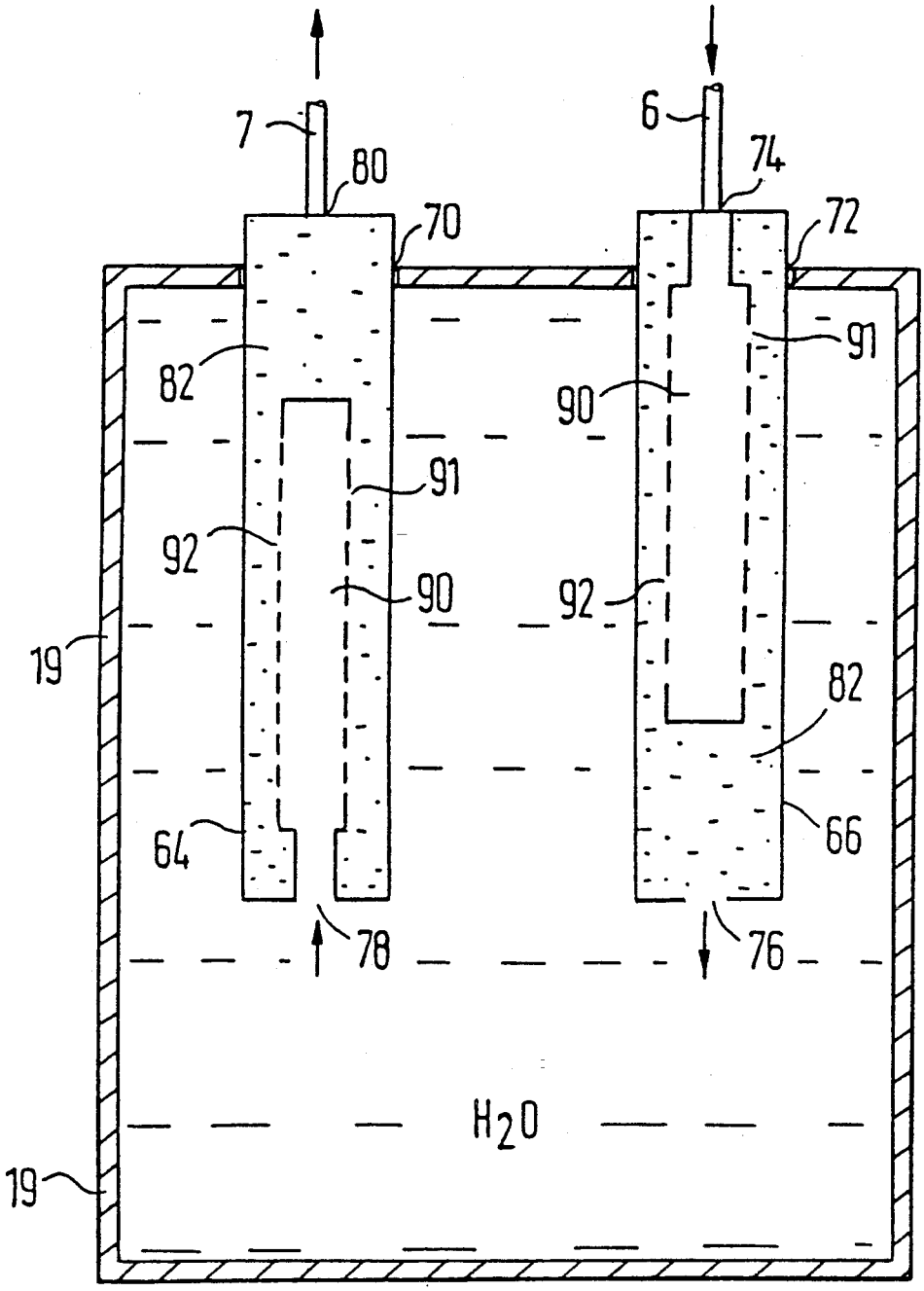
FIG. 3 is a cross-sectional side view of a reservoir for a medium source, in accordance with one embodiment of this invention.

FIG. 1 and FIG. 3 show two ion exchangers 64 and 66 for regenerating the rinse water disposed in the rinse water reservoir 19. The ion exchangers 64 and 66 each consist of a hollow body, removably connected to the reservoir inlet opening 72 or reservoir outlet opening 70 of the reservoir (process chamber) 14, have an exchanger inlet and exchanger outlet opening 74, 78 or 76 and 80. Means 82, preferably a resin, for absorbing ions are disposed between these openings.

In accordance with one embodiment of this invention, a liquid having ions, for example water, flows through the exchanger inlet line 6 into rinse water reservoir 19 and into a hollow body 90 of first ion exchanger 66. This cylindrical hollow body 90 has a plurality of radially oriented holes 91 and 92. The liquid flowing from the hollow body 90 passes through ion-absorbing means 82 and reaches the interior of the rinse water reservoir 19 through first exchanger outlet opening 76. The liquid flowing through first exchanger outlet opening 76 into the interior of rinse water reservoir is essentially free of one of cations or anions. From there, the liquid follows into the interior of second ion exchanger 64 through second exchanger inlet opening 78, which is constructed essentially the same as the first ion exchanger 66 which, however, absorbs one of cations or anions not absorbed by first ion exchanger 66. Consequently the liquid flowing through exchanger outlet line 7 has been freed of ions. When the ion exchangers 64 and 66 no longer function, they are removed from rinse water exchanger 19 and replaced by others.

The wall 28 of the container 14 may also be disposed as a magazine for blanks.

Thus, a significant feature of this invention is the fact that not only large pieces, such as pipes of a length of several meters, but also small articles, such as screws, rings or artificial teeth can be. To prevent oxidation of the coating, it is possible to react the electrolyte with, for example, nitrogen. Using additional devices, the electrolyte may be swirled, for example, by stirring or ultrasound. It is preferred to use non-soluble anodes or electrodes. It is also assured that no evaporation losses of the liquids take place.

When producing galvanic coatings of workpieces with uneven surfaces, the distance between the anode and the cathode (workpieces) has a decisive effect on the thickness of the coating. Thickness in this case depends on the current density and the time of exposure. Because of nonuniform current intensity at edges, recesses and bulges of the workpieces, the thickness of the coating is not quite uniform. This is because the recesses are at a greater distance from the anode than the front of the workpiece facing the anode.

A partial solution is obtained by distancing the anode far enough from the workpieces that the depth of the recesses is infinitesimally small in comparison to the distance of the anode from the cathode. However, this requires that the container be made larger, a distinct disadvantage.

Figure 4:
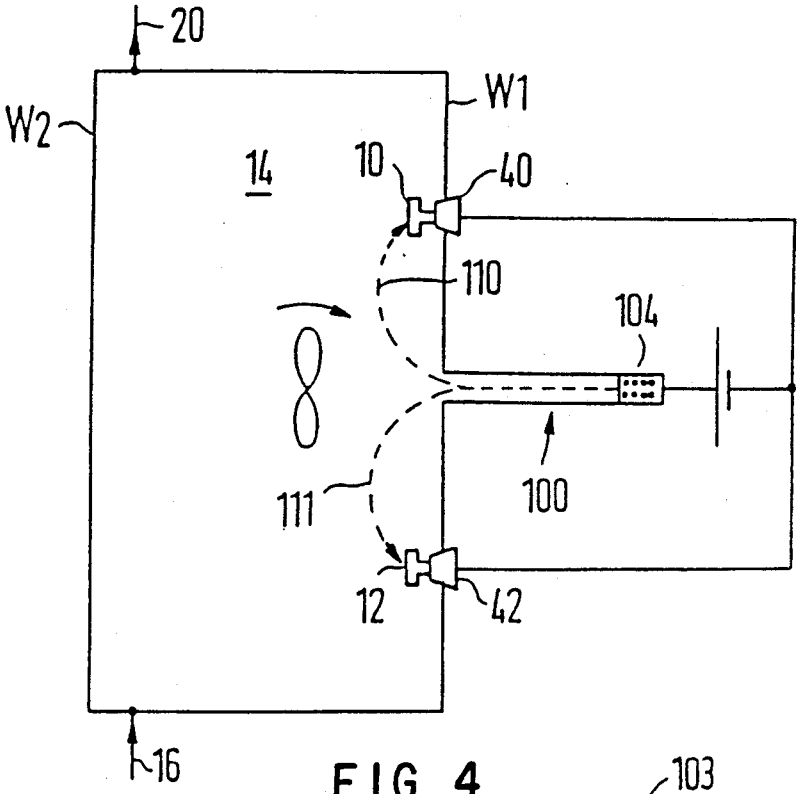
FIG. 4 is a schematic diagram of a container (process chamber) having an anode disposed outside of the container in accordance with another embodiment of this invention.
Figure 5:
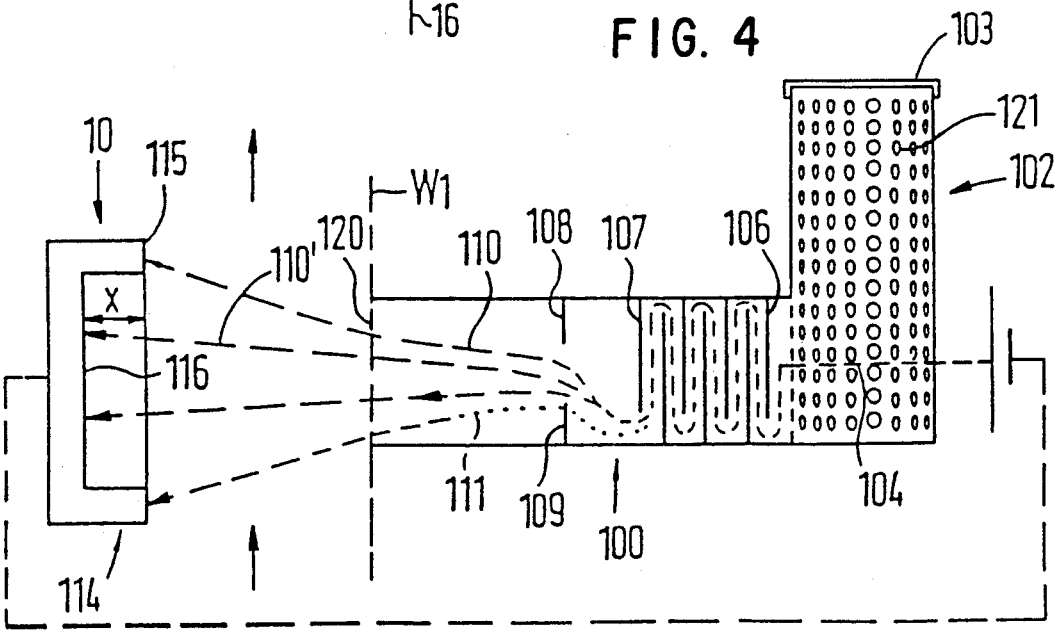
FIG. 5 is a schematic diagram of an anode in relationship to a workpiece in accordance with another embodiment of this invention.

In FIGS. 4 and 5 it is shown that the length of the lines of electric flux 110 and 111 is very great, although the distance between the anode 104 and the work pieces 10 and 12 is relatively short. The anode 104 is housed in a receptacle 100, the distance of which from the workpiece 10 is noticeably less than the length of the lines of electric flux 110 and 111 between the anode 104 and the cathode 10. The receptacle 100 is disposed outside of the container (process chamber) 14. In accordance with one embodiment of this invention, receptacle 100 is a stretched body, the open side of which communicates with the container (process chamber) 14. A plurality of baffles 106 and 107 is disposed between the open side 120 and the anode 104. The baffles 106 and 107 are in the form of guide plates, so that the lines of electrical flux 110 and 111 are in the form of serpentines and meanders. Consequently, the length of the lines of electrical flux—measured from the anode 104 to the workpiece 10—is increased such that the bottom 116, which is further away from the anode by a distance x, is approximately as far from the anode as the front 115 of the workpiece 10. If the length of the lines of electrical flux is called d, that is, the length of the line of electrical flux 110 from the anode to the front 115, and the length of the line of flux 110' is d+x, then d/d+x is approximately 1. The current intensity is approximately as great in the bottom area 116 as in the front area 115, so that the thickness of the coating is approximately the same.

Screens 108 and 109 are provided for focusing the lines of electrical flux 110 and 111, so that the lines of electrical flux 110 and 111 leave the aperture 120 with approximately the same density.

FIG. 5 furthermore shows that the anode 104 is surrounded by grain-shaped particles 121, which may be of copper, nickel, gold, silver, chromium or the like. The particles 121 are housed in a collector 102, which communicates with the receptacle 100. The receptacle 100 and the collector 102 are made of one piece and essentially L-shaped, the lower portion of the collector 102 surrounding the anode. In this way galvanic coatings are prepared by electrolytic decomposition of metal salt solutions. Accordingly, it is possible to produce a copper coating on the metallic object 10 by suspending the object as a cathode in a copper sulfate solution and to employ an anode comprising a plate which is surrounded by copper particles, for example, granulate, small spheres, etc. The $Cu^{++}$ ions migrate to the negatively charged object and there form the layer, while the remaining acid ions $SO_4^{--}$ free fresh $Cu^{++}$ ions from the Cu anode, so that the concentration of the solution is maintained. The current density must be maintained sufficiently low, to prevent the Cu coat from becoming porous and spongy. By using the granulate, the distance of the anode 104 from the workpiece 10 is maintained constant, because the used-up granulate disposed in the area of the bottom of the anode 10 can be replaced by fresh granulate, which extends as far as the cover 103.

Figure 6:
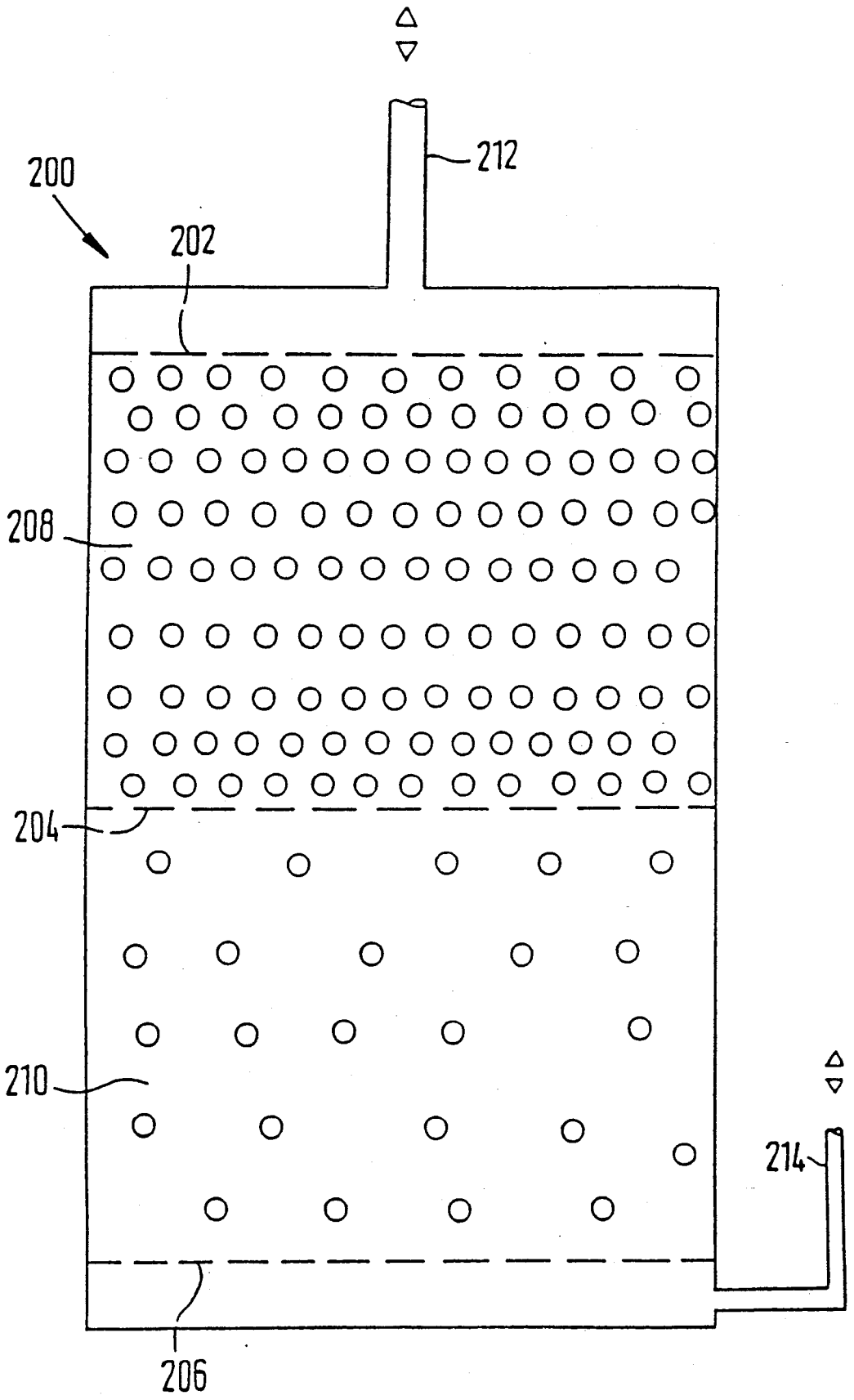
FIG. 6 a schematic diagram of a reservoir for a medium source in accordance with another embodiment of this invention.

Finally, FIG. 6 illustrates a reservoir 200 in accordance with another embodiment of this invention which approximately corresponds to the reservoir 19 according to FIG. 1. The essential difference between the reservoir 200 and the medium reservoir 19 is that the entire reservoir 200 is designed as an ion exchanger, which can be connected to inlet line 16 and outlet line 20 through the radial sliding valve 24 by connections 212 and 214. The reservoir (ion exchanger) 200 has three filters 202, 204 and 206, between which ion absorption material, for example, a resin, for cations 208 or anions 210 is disposed. This ion exchanger 200 can be operated in either direction.

I claim:

1. In a device for one of applying and removing coatings on workpieces, having a conveying device and a container which receives the workpieces, an inlet line connected to at least one medium source and an outlet line connecting the container to the medium source, the medium source being disposed below the conveying device, where the inlet line and the outlet line are connected to the medium source by a control device which is connectable to at least three different said medium sources and disposed below the container, the improvement comprising, the conveying device (26) is a vacuum pump and is incorporated in the outlet line (20) of the container (14).

2. In a device in accordance with claim 1, wherein the inlet line (16) terminates in an area of a lowest point of the container (14).

3. In a device in accordance with claim 2 further comprising means for continuously circulating at least one medium in a closed cycle.

4. In a device in accordance with claim 3, wherein a valve (V) is incorporated in the outlet line (20) between the conveying device (26) and the container (14).

5. In a device in accordance with claim 4, wherein means (3) for swirling are disposed in the container (14) by which said medium present in the container (14) can be swirled.

6. In a device in accordance with claim 5, wherein a wall (28) of the container (14) has at least one workpiece opening (30, 32) for a holder (40, 42) for at least one said workpiece (10, 12).

7. In a device in accordance with claim 6, wherein said holder (40, 42) for said workpiece (10, 12) has an elastically deformable sealing section secured under pressure to the wall (28).

8. In a device in accordance with claim 7, wherein a sheathing of said workpiece opening (30, 32) is in a shape of a truncated cone, and tapers towards an interior of the container (14).

9. In a device in accordance with claim 8 further comprising an electrode, means for electrically charging said workpiece (10, 12), each of said electrode and said means for electrically charging said workpiece (10, 12) connected to a voltage supply, and an electrolyte (46) flowing between said electrode and said means for electrically charging said workpiece (10, 12).

10. In a device in accordance with claim 9, wherein at least one of said medium sources is an electrolyte reservoir, at least one of said medium sources is a pre-rinse and rinse water reservoir (19), and at least one ion exchanger (64, 66) for regeneration of rinse water is disposed in said pre-rinse and rinse water reservoir (19).

11. In a device in accordance with claim 10, wherein two said ion exchangers (64, 66) are disposed in said pre-rinse and rinse water reservoir (19).

12. In a device in accordance with claim 11, wherein said ion exchanger (64, 66) comprises a hollow body, removably connected to one of a reservoir inlet opening and a reservoir outlet opening (70, 72) of said pre-rinse and rinse water reservoir (19) and having an exchanger inlet opening (74, 78) and an exchanger outlet opening (76, 80), and means (82) for absorbing ions disposed between said exchanger inlet opening (74, 78) and said exchanger outlet opening (76, 80).

13. In a device in accordance with claim 12, wherein said electrode (104) is housed in a receptacle (100) in communication with said container, whereby a distance of said electrode (104) from the workpiece (10) is less than a length of a line of electrical flux (110, 111) between said electrode (104) and the workpiece (10).

14. In a device in accordance with claim 13, wherein said receptacle (100) is disposed outside of the container (14).

15. In a device in accordance with claim 14, wherein said receptacle (100) is a stretched body having an open side (12) which communicates with the container (14) and a plurality of baffles (106, 107) are formed between a side (120) of said receptacle (100) and said anode (104).

16. In a device in accordance with claim 15, wherein said plurality of baffles (106, 107) are in the form of guide plates producing said line of electrical flux (110, 111) which is serpentine.

17. In a device in accordance with claim 16, wherein said anode (104) is surrounded by a plurality of granulate-shaped particles (121) selected from the group consisting of Cu, Ni, Au, Ag, Cr, Sn and mixtures thereof.

18. In a device in accordance with claim 17, wherein said plurality of granulate-shaped particles (121) are housed in a collector (102) which is in communication with said receptacle (100).

19. In a device in accordance with claim 18, wherein said receptacle (100) and said collector (102) are made of one piece and are essentially L-shaped, where a lower end of the collector (102) surrounds an electrode.

20. In a device in accordance with claim 1 further comprising means for continuously circulating at least one medium in a closed cycle.

21. In a device in accordance with claim 1, wherein a valve (V) is incorporated in the outlet line (20) between the conveying device (26) and the container (14).

22. In a device in accordance with claim 1, wherein means (3) for swirling are disposed in the container (14) by which a medium present in the container (14) can be swirled.

23. In a device in accordance with claim 1, wherein a wall (28) of the container (14) has at least one workpiece opening (30, 32) for a holder (40, 42) for at least one said workpiece (10, 12).

24. In a device in accordance with claim 1, wherein a holder (40, 42) for said workpiece (10, 12) has an elastically deformable sealing section secured under pressure to a wall (28) of said container (14).

25. In a device in accordance with claim 1, wherein a sheathing of a workpiece opening (30, 32) is in a shape of a truncated cone, and tapers towards an interior of the container (14).

26. In a device in accordance with claim 1 further comprising an electrode, means for electrically charging said workpiece (10, 12), each of said electrode and said means for electrically charging said workpiece (10, 12) connected to a voltage supply, and an electrolyte (46) flowing between said electrode and said means for electrically charging said workpiece (10, 12).

27. In a device in accordance with claim 26, wherein an ion exchanger (64, 66) comprises a hollow body, removably connected to one of a reservoir inlet opening and a reservoir outlet opening (70, 72) of a pre-rinse and rinse water reservoir (19) and having an exchanger inlet opening (74, 78) and an exchanger outlet opening (76, 80), and means (82) for absorbing ions are disposed between said exchanger inlet opening (74, 78) and said exchanger outlet opening (76, 80).

28. In a device in accordance with claim 1, wherein at least one of said medium sources is an electrolyte reservoir, at least one of said medium sources is a pre-rinse and rinse water reservoir (19), and at least one ion exchanger (64, 66) for regeneration of rinse water is disposed in said pre-rinse and rinse water reservoir (19).

29. In a device in accordance with claim 28, wherein two ion exchangers (64, 66) are disposed in said pre-rinse and rinse water reservoir (19).

30. In a device in accordance with claim 1, wherein an electrode (104) is housed in a receptacle (100) in communication with said container, whereby a distance of said electrode from the workpiece (10) is less than a length of a line of electrical flux (110, 111) between said electrode (104) and the workpiece (10).

31. In a device in accordance with claim 1, wherein a receptacle (100) is disposed outside of the container (14).

32. In a device in accordance with claim 1, wherein a receptacle (100) is a stretched body having an open side (12) which communicates with the container (14), and a plurality of baffles (106, 107) are formed between a side (120) of said receptacle (100) and an anode (104).

33. In a device in accordance with claim 1, wherein a plurality of baffles (106, 107) in a receptacle which communicates with said container are in the form of guide plates producing lines of electrical flux (110, 111) which are serpentine.

34. In a device in accordance with claim 1, wherein in a receptacle which communicates with said container is surrounded by a plurality of granulate-shaped particles (121) selected from the group consisting of Cu, Ni, Au, Ag, Cr, Sn and mixtures thereof.

35. In a device in accordance with claim 1, wherein a plurality of granulate-shaped particles (121) are housed in a collector (102) which is in communication with a receptacle (100), said receptacle in communication with said container.

36. In a device in accordance with claim 1, wherein a receptacle (100) in communication with said container and a collector (102) in communication with said receptacle (100) are made of one piece and are essentially L-shaped, where a lower end of the collector (102) surrounds an electrode.

* * * * *